US011642902B2

(12) United States Patent
Asada et al.

(10) Patent No.: US 11,642,902 B2
(45) Date of Patent: May 9, 2023

(54) PRINTING APPARATUS AND PRINTING METHOD

(71) Applicant: SEIKO EPSON CORPORATION, Tokyo (JP)

(72) Inventors: Tatsuya Asada, Nagano (JP); Kazuya Nakagawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/649,074

(22) Filed: Jan. 27, 2022

(65) Prior Publication Data

US 2022/0242152 A1 Aug. 4, 2022

(30) Foreign Application Priority Data

Jan. 29, 2021 (JP) ..... JP2021-013267

(51) Int. Cl.

| | |
|---|---|
| ***B41J 13/00*** | (2006.01) |
| ***B41J 11/42*** | (2006.01) |
| ***B41J 19/20*** | (2006.01) |
| ***B41J 19/14*** | (2006.01) |
| ***B41J 25/00*** | (2006.01) |
| ***B41J 2/21*** | (2006.01) |
| ***B41J 29/38*** | (2006.01) |
| *B41J 2/01* | (2006.01) |

(52) U.S. Cl.

CPC ..... *B41J 25/006* (2013.01); *B41J 2/2132* (2013.01); *B41J 11/42* (2013.01); *B41J 13/0009* (2013.01); *B41J 19/142* (2013.01); *B41J 19/202* (2013.01); *B41J 29/38* (2013.01); *B41J 2/01* (2013.01)

(58) Field of Classification Search

CPC ..... B41J 25/006; B41J 2/2132; B41J 11/42; B41J 13/0009; B41J 19/142; B41J 19/202; B41J 29/38; B41J 2/01

See application file for complete search history.

(56) References Cited

U.S. PATENT DOCUMENTS

2006/0023051 A1* 2/2006 Akiyama ..... B41J 13/0009 347/104
2018/0207961 A1* 7/2018 Mori ..... B41J 13/0009

FOREIGN PATENT DOCUMENTS

JP 2004-175082 A 6/2004
JP 2004175082 A * 6/2004 ..... B41J 11/42
JP 2010-036447 A 2/2010

* cited by examiner

*Primary Examiner* — Yaovi M Ameh

(74) *Attorney, Agent, or Firm* — Global IP Counselors, LLP

(57) ABSTRACT

A control unit configured to perform multi-pass printing provided that a region of a printing medium including a first region, a region downstream of the first region is a second region, and a region downstream of the second region is a third region, in a first period in which the first region is a target of printing, causes a velocity of paper feed to be slower than in a third period in which the third region is a target of printing; in the first period, causes a standby time of the printing head to be longer than in the third period; and in a second period in which the second region is a target of printing, changes the standby time so that the standby time approaches the standby time in the first period from the standby time in the third period as the first region approaches the printing head.

5 Claims, 6 Drawing Sheets

PRINTING APPARATUS AND PRINTING METHOD

The present application is based on, and claims priority from JP Application Serial Number 2021-013267, filed Jan. 29, 2021, the disclosure of which is hereby incorporated by reference herein in its entirety.

BACKGROUND

1. Technical Field

The present disclosure relates to a printing apparatus and a printing method.

2. Related Art

In serial printers, printing is applied to a sheet transported by a paper feed roller pair and a paper discharge roller pair by a method in which ink is ejected from a printing head provided between both roller pairs. Ink ejection by the printing head when a carriage with the printing head mounted thereon is moved in the main scanning direction, and paper feed by each roller being driven is alternately performed, whereby printing to a sheet progresses (see JP-A-2004-175082).

In this type of serial printers, when the trailing end of a sheet leaves the paper feed roller pair, a kicking phenomenon occurs in which the trailing end is kicked (flicked) by the rotating paper feed roller pair. Due to this kicking phenomenon, the actual paper feed amount becomes greater than the paper feed amount assumed in the designing, resulting in decreased sheet position accuracy in the transport direction. A method is known in which, in order to suppress this kicking phenomenon from occurring, a low-velocity region is set in a range where the trailing end of the sheet passes through the paper feed roller pair, and the paper feed velocity is changed to a velocity slower than the normal velocity when the trailing end of the sheet passes through this low-velocity region.

When the paper feed velocity of the printing medium is slowed for a certain period of time in order to suppress the kicking phenomenon, the drying time of ink in the process up to print completion will be different region by region in the printing medium. This difference in drying time will be visible as region-by-region difference in density in the printing result, that is, density unevenness. There is a demand for devising ways to make such density unevenness inconspicuous as much as possible.

SUMMARY

A printing apparatus includes: a printing head configured to execute a pass for ejecting liquid while moving forward along a main scanning direction and a pass for ejecting liquid while moving backward along the main scanning direction, a transport unit configured to transport a printing medium in a transport direction intersecting the main scanning direction using a first transport member and a second transport member, and a control unit configured to perform multi-pass printing in which a raster line along the main scanning direction is printed in a plurality of passes on the printing medium by controlling the printing head and the transport unit, wherein the first transport member is a roller pair disposed upstream of the printing head in the transport direction, the second transport member is disposed downstream of the printing head in the transport direction, and provided that a region of the printing medium including a region that is a target of printing by the printing head while a trailing end, which is an upstream end portion of the printing medium in the transport direction, passes through the first transport member and the printing medium is transported by the second transport member is a first region, a region downstream of the first region in the printing medium is a second region, and a region downstream of the second region in the printing medium is a third region, the control unit, in a first period in which the first region is a target of printing by the printing head, causes a velocity of transport of the printing medium executed by the transport unit between the pass and a pass next to the pass to be slower than in a third period in which the third region is a target of printing by the printing head, in the first period, causes a standby time of the printing head between the pass and a pass next to the pass to be longer than in the third period, and in a second period in which the second region is a target of printing by the printing head, changes the standby time so that the standby time approaches the standby time in the first period from the standby time in the third period as the first region approaches the printing head.

A printing method includes: a printing control step for performing multi-pass printing in which a raster line along a main scanning direction is printed in a plurality of passes on a printing medium by controlling a printing head configured to execute a pass for ejecting liquid while moving forward along the main scanning direction and a pass for ejecting liquid while moving backward along the main scanning direction and a transport unit configured to transport, using a first transport member disposed upstream of the printing head and a second transport member disposed downstream of the printing head in a transport direction intersecting the main scanning direction, the printing medium in the transport direction, the first transport member being a roller pair and in the printing control step, provided that a region of the printing medium including a region that is a target of printing by the printing head while a trailing end, which is an upstream end portion of the printing medium in the transport direction, passes through the first transport member and the printing medium is transported by the second transport member set as a first region, a region downstream of the first region in the printing medium is a second region, and a region downstream of the second region in the printing medium is a third region, in a first period in which the first region is a target of printing by the printing head, a velocity of transport of the printing medium executed by the transport unit between the pass and a pass next to the pass is slower than in a third period in which the third region is a target of printing by the printing head, in the first period, a standby time of the printing head between the pass and a pass next to the pass is longer than in the third period, and in a second period in which the second region is a target of printing by the printing head, the standby time is changed so as to approach the standby time in the first period from the standby time in the third period as the first region approaches the printing head.

DESCRIPTION OF EXEMPLARY EMBODIMENTS

Hereinafter, embodiments of the present disclosure will be described with reference to the accompanying drawings. Note that each of the drawings is merely illustrative for describing the present embodiment. Since the drawings are illustrative, proportions and shapes may not be precise; the drawings may not match each other; and some portions may be omitted.

1. Apparatus Configuration

Figure 1:
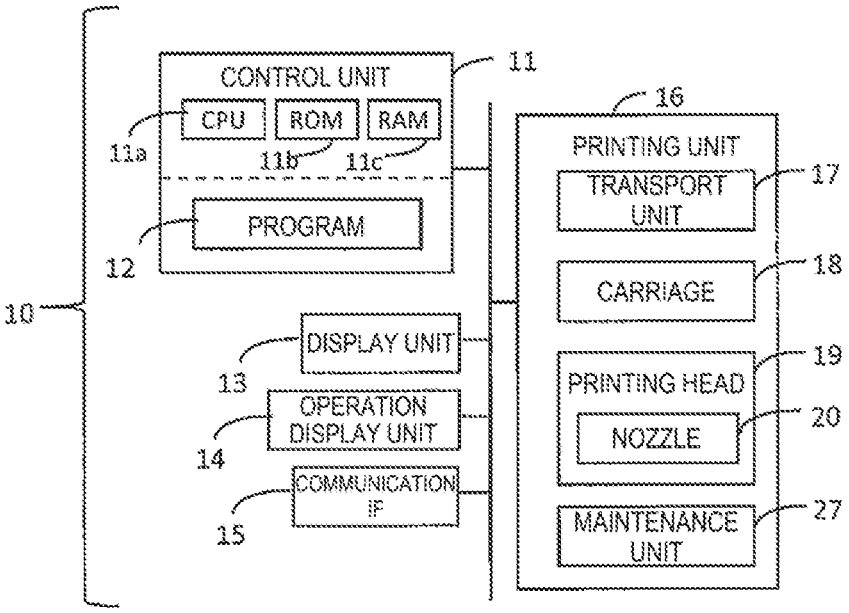
FIG. 1 is a block diagram illustrating an apparatus configuration in a simplified manner.

FIG. 1 illustrates a configuration of a printing apparatus 10 according to the present embodiment in a simplified manner.

The printing apparatus 10 includes a control unit 11, a display unit 13, an operation receiving unit 14, a communication IF 15, a printing unit 16, and the like. The printing unit 16 includes a transport unit 17, a carriage 18, a printing head 19, a maintenance unit 27, and the like. IF is an abbreviation for interface. The control unit 11 includes one or a plurality of integrated circuits (IC) including a central processing unit (CPU) 11*a* as a processor, a read-only memory (ROM) 11*b*, and a random access memory (RAM) 11*c*, as well as other components such as a non-volatile memory.

In the control unit 11, the processor, that is, the CPU 11*a* executes arithmetic processing in accordance with one or more programs 12 stored in the ROM 11*b* or other components such as a memory using the RAM 11*c* or the like as a work area, thereby controlling the printing apparatus 10. Note that the processor is not limited to a single CPU. Processing may be performed by a plurality of CPUs or a hardware circuit such an application-specific integrated circuit (ASIC), and processing may be performed by a CPU and a hardware circuit working in concert.

The display unit 13 is a means for displaying visual information. The display unit 13 is constituted, for example, by a liquid crystal display, an organic electroluminescence (EL) display, or the like. The display unit 13 may include a display and a driving circuit for driving the display. The operation receiving unit 14 is a means for receiving an operation by a user. The operation receiving unit 14 is realized, for example, by a physical button, a touch panel, a mouse, a keyboard, or the like. Of course, the touch panel may be realized as a function of the display unit 13.

The display unit 13 and the operation receiving unit 14 may constitute part of the configuration of the printing apparatus 10, but may be peripheral devices externally coupled to the printing apparatus 10. The communication IF 15 is a generic term for one or a plurality of IFs for connecting the printing apparatus 10 with the outside in a wired or wireless manner compliant with a predetermined communication protocol including a known communication standard.

The printing unit 16 is a mechanism for performing printing by an ink-jet method.

The transport unit 17 is a means for transporting a printing medium such as a sheet in a predetermined transport direction. The transport unit 17 includes a roller, a motor for rotating the roller, and the like. The printing medium may be a medium formed of a material other than paper as long as the medium is printable by liquid. Upstream and downstream in the transport direction may also be simply referred to as upstream and downstream. The printing head 19 includes a plurality of nozzles 20. The printing head 19 ejects or does not eject a dot of liquid such as ink from the nozzles 20 based on print data generated by the control unit 11 for printing an image, thereby printing the image to a printing medium. The printing head 19 is capable of ejecting ink of various colors such as a cyan (C) ink, a magenta (M) ink, a yellow (Y) ink, and a black (K) ink, for example. Of course, the printing head 19 may also eject ink or liquid having a color other than CMYK.

The carriage 18 is a mechanism capable of reciprocating along a predetermined main scanning direction as a result of receiving power from a carriage motor (not illustrated). The main scanning direction intersects the transport direction. To intersect herein may be understood as to be orthogonal or substantially orthogonal. The printing head 19 is mounted on the carriage 18. In other words, the printing head 19 reciprocates, along with the carriage 18, along the main scanning direction.

Figure 2:
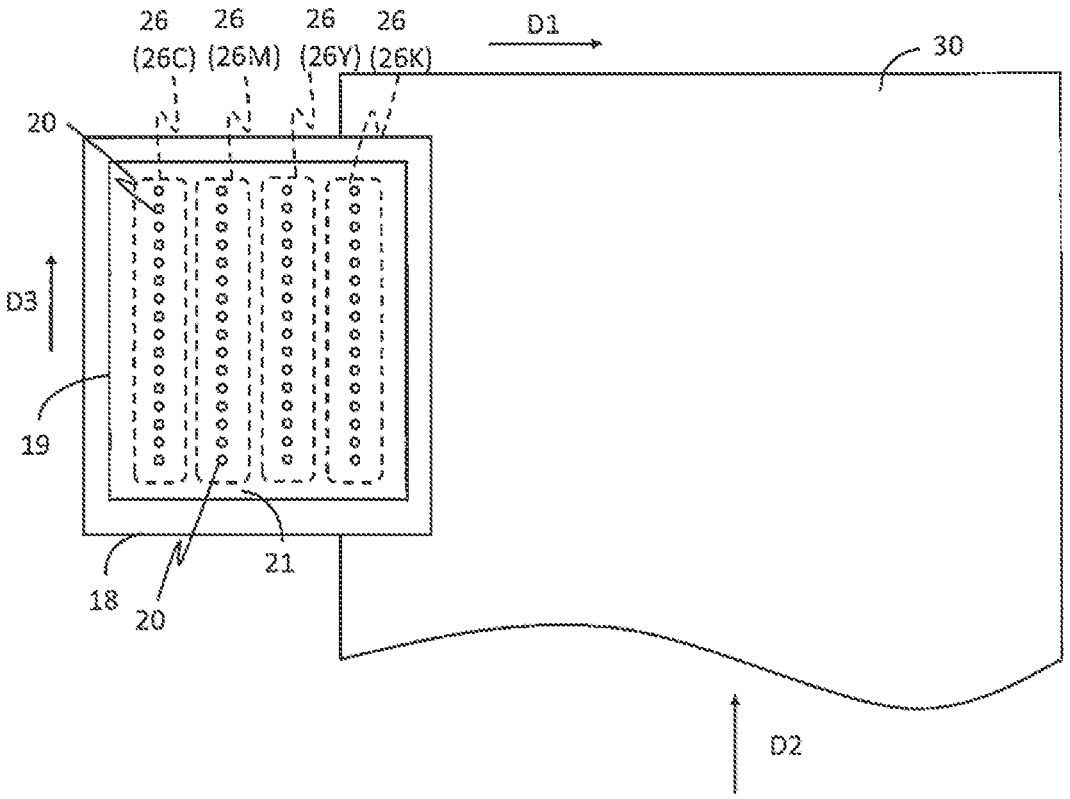
FIG. 2 is a view illustrating a relationship between a printing medium and a printing head as seen from above.

FIG. 2 illustrates a relationship between a printing medium 30 and the printing head 19 in a simplified manner as seen from above. Along with the carriage 18, the printing head 19 mounted on the carriage 18 moves from one end to the other end of a main scanning direction D1 (forward movement) and moves from the other end to the one end (backward movement).

FIG. 2 illustrates an example of an arrangement of the nozzles 20 in a nozzle surface 21. The nozzle surface 21 is the lower surface of the printing head 19. Each small circle in the nozzle surface 21 is a nozzle 20. In a configuration in which ink of each color is supplied from a liquid holding means (not illustrated) that is called an ink cartridge, an ink tank, and the like and ejected from the nozzles 20, the printing head 19 includes a nozzle row 26 for each ink color. FIG. 2 illustrates an example of the printing head 19 that ejects CMYK inks. The nozzle row 26 including the nozzles 20 that eject the C ink is a nozzle row 26C. Similarly, the nozzle row 26 including the nozzles 20 that eject the M ink is a nozzle row 26M, the nozzle row 26 including the nozzles 20 that eject the Y ink is a nozzle row 26Y, and the nozzle row 26 including the nozzles 20 that eject the K ink is a nozzle row 26K. The nozzle rows 26C, 26M, 26Y, and 26K are aligned along the main scanning direction D1.

Each of the nozzle rows 26 is constituted by a plurality of nozzles 20 having a constant or substantially constant nozzle pitch, which is an interval between nozzles 20 in a transport direction D2. The direction in which a plurality of nozzles 20 constituting a nozzle row 26 are aligned is a nozzle row direction D3. In the example illustrated in FIG. 2, the nozzle row direction D3 is parallel with the transport direction D2. In a configuration in which the nozzle row direction D3 is parallel with the transport direction D2, the nozzle row direction D3 and the main scanning direction D1 are orthogonal to each other. However, the nozzle row direction D3 need not be parallel with the transport direction D2, and may diagonally intersect the main scanning direction D1.

The operation in which the printing head 19 ejects liquid such as ink in association with forward movement of the carriage 18 along the main scanning direction D1 and the operation in which the printing head 19 ejects liquid such as ink in association with backward movement of the carriage 18 along the main scanning direction D1 are called a main scanning or a pass. A pass of forward movement may also be called a forward pass, while a pass of backward movement may also be called a backward pass. The printing unit 16 combines passes and transport of the printing medium 30 in the transport direction D2 by a constant amount by the transport unit 17 (hereinafter, paper feed) to perform printing to the printing medium 30. More specifically, the printing unit 16 executes a single paper feed in the period of time after a single pass is ended until the next pass is started. For passes, the printing unit 16 alternately executes a forward pass and a backward pass. The period of time after a pass is ended until the next pass is started represents a standby time for the carriage 18 and the printing head 19. The standby time for the carriage 18 and the printing head 19 is also simply referred to as the standby time.

The configuration of the printing apparatus 10 illustrated in FIG. 1 may be realized by a single printer, and may be realized by a plurality of apparatuses communicatively coupled to each other.

In other words, the printing apparatus 10 may be a printing system 10 in actuality. The printing system 10 includes, for example, a printing control apparatus that functions as the control unit 11, and a printer corresponding to the printing unit 16 controlled by the printing control apparatus. A printing method according to the present embodiment is realized by such a printing apparatus 10 or such a printing system 10.

Figure 3:
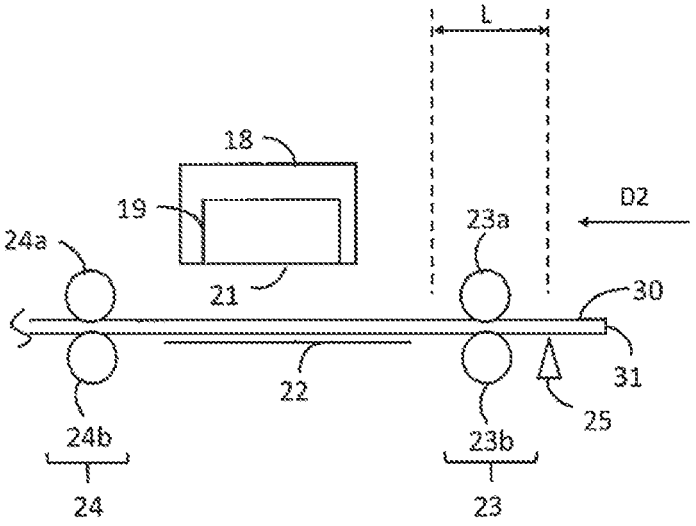
FIG. 3 is a view illustrating a relationship between a printing medium and a printing head as seen from a viewpoint facing a main scanning direction.

FIG. 3 illustrates a relationship between the printing medium 30 and the printing head 19 in a simplified manner as seen from a viewpoint facing the main scanning direction D1. The nozzle surface 21 of the printing head 19 mounted on the carriage 18 is opposed to a platen 22. The platen 22 supports the printing medium 30 that is transported at a position below the printing head 19. The platen 22 constitutes part of a transport path for the printing medium 30.

A transport roller pair 23 as a first transport member is disposed upstream of the printing head 19. The transport roller pair 23 is a pair of rollers 23*a* and 23*b*. The transport roller pair 23 rotates while sandwiching the printing medium 30 by the rollers 23*a* and 23*b*, thereby transporting the printing medium 30. One of the rollers 23*a* and 23*b* constituting the roller pair 23 is driven by a motor (not illustrated), while the other is rotated as a driven roller. Furthermore, a discharge roller pair 24 as a second transport member is disposed downstream of the printing head 19. The discharge roller pair 24 is a pair of rollers 24*a* and 24*b*. The discharge roller pair 24 rotates while sandwiching the printing medium 30 by the rollers 24*a* and 24*b*, thereby transporting the printing medium 30. One of the rollers 24*a* and 24*b* constituting the roller pair 24 is driven by the same motor (not illustrated) as that for the transport roller pair 23, while the other is rotated as a driven roller.

The transport roller pair 23 and the discharge roller pair 24 each constitute part of the transport unit 17. In the example of FIG. 3, the transport unit 17 transports the printing medium 30 in the transport direction D2 using both or one of the transport roller pair 23 and the discharge roller pair 24. Note that it is sufficient that the second transport member is a means capable of transporting the printing medium 30 downstream of the printing head 19. The second transport member need not be limited to a roller pair. Furthermore, the transport unit 17 may also include, at a position upstream of the transport roller pair 23 or at a position downstream of the discharge roller pair 24, a roller (not illustrated) or the like for transporting the printing medium 30.

A printing medium sensor 25 is disposed upstream of the printing head 19. In the example of FIG. 3, the printing medium sensor 25 is located slightly upstream of the transport roller pair 23. The printing medium sensor 25 is capable of detecting the leading end or the trailing end of the printing medium 30 that is transported. In the present embodiment, with respect to the printing medium 30 and other objects, structures, and the like, the downstream end portion is called the leading end, while the upstream end portion is called the trailing end. In FIG. 3, the leading end of the printing medium 30 is not illustrated, whereas the trailing end of the printing medium 30 is indicated by reference numeral 31.

In FIG. 3, a range from a predetermined position slightly upstream of the transport roller pair 23 to a predetermined position slightly downstream of the transport roller pair 23 is set as a low-velocity range L in the transport direction D2. The control unit 11 carries out control so that velocity VU>velocity VL, wherein the velocity VU is the normal velocity of paper feed of the printing medium 30 by the transport unit 17 while the velocity VL is the paper feed velocity in a period in which the trailing end 31 of the printing medium 30 passes through the low-velocity range L. In other words, the control unit 11 drops the velocity of paper feed by the transfer unit 17 from the velocity VU to the velocity VL in a period in which the trailing end 31 passes through the low-velocity range L to prevent the kicking phenomenon described above from occurring when the trailing end 31 passes through the transport roller pair 23.

2. Printing Control Processing

Figure 4:
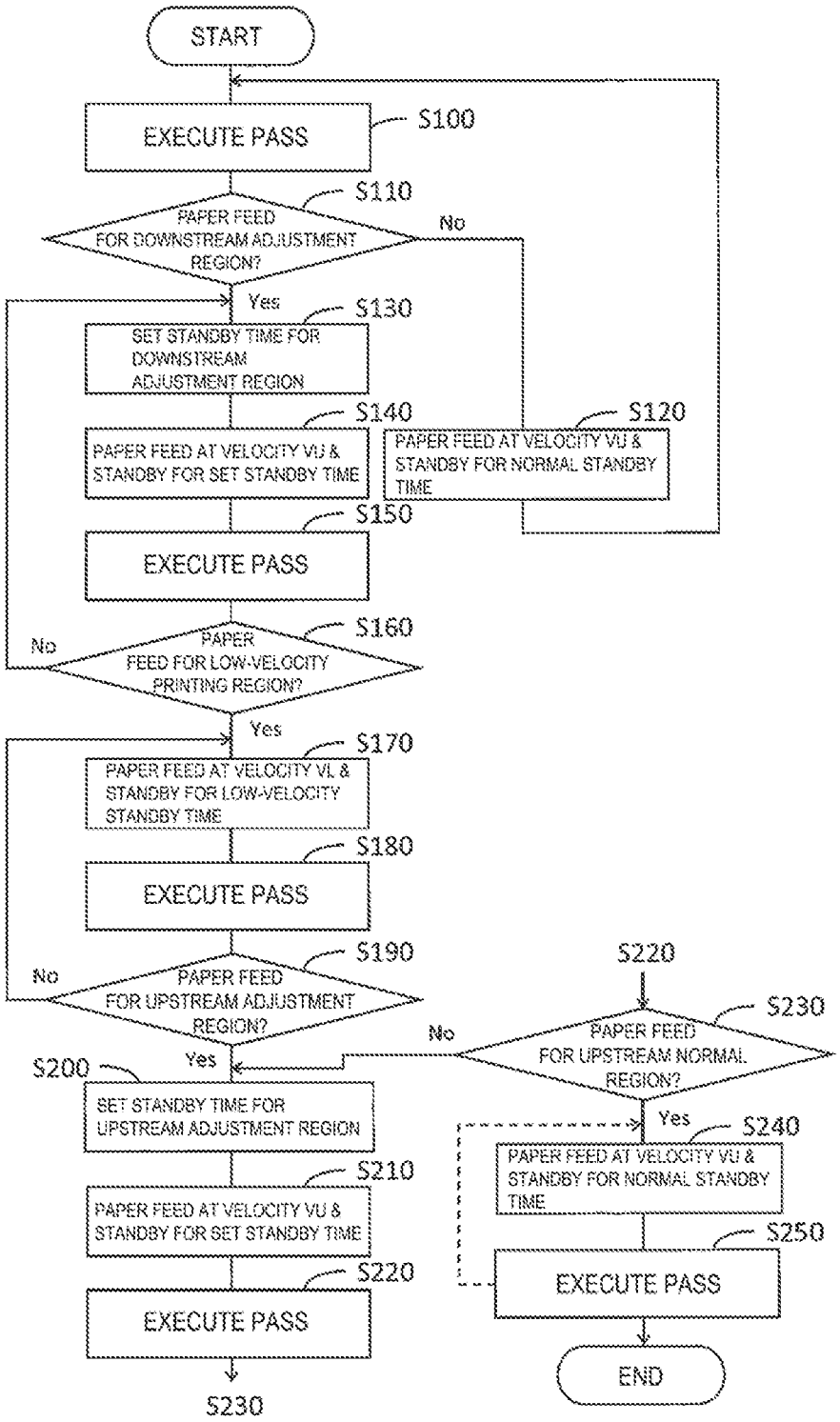
FIG. 4 is a flowchart illustrating printing control processing.

FIG. 4 illustrates printing control processing executed by the control unit 11 in accordance with the program 12 in a flowchart. This printing control processing includes a "printing control step" according to the present embodiment. Here, for ease of explanation, a scene is assumed in which a cut sheet, which is cut in advance on a page-by-page basis, is used as the printing medium 30, and in which one page's worth of print data is printed to a single sheet of a cut sheet. When performing a plurality of pages' worth of printing, it is sufficient that the flowchart of FIG. 4 is repeatedly executed. In the present embodiment, the control unit 11 performs multi-pass printing in which a raster line along the main scanning direction D1 is printed in a plurality of passes on the printing medium 30 by controlling the printing head 19 and the transport unit 17. A raster line is a pixel row including a plurality of pixels aligned along the main scanning direction D1 in the state of print data.

With the top-of-form positioning of the printing medium 30 by the transport unit 17 being ended, the control unit 11 starts the flowchart of FIG. 4. Top-of-form positioning is the processing for transporting the printing medium 30 to a predetermined position at which the printing medium 30 may be subjected to a first pass by the printing head 19. The control unit 11 causes the transport unit 17 to start transport of the printing medium 30 loaded in a paper feed tray (not illustrated). With the timing when the leading end of the printing medium 30 is detected by the printing medium sensor 25 as a reference, for example, the control unit 11 causes the printing medium 30 to be transported therefrom by a predetermined distance, thereby ending the top-of-form positioning.

In step S100, the control unit 11 controls the carriage 18 and the printing head 19 to execute a single pass on the printing medium 30. The pass executed in step S100 is a pass in a third period. The third period will be described later.

In step S110, the control unit 11 determines whether the paper feed to be executed after the pass executed in step S100 is a paper feed for the "downstream adjustment region".

Figure 5:
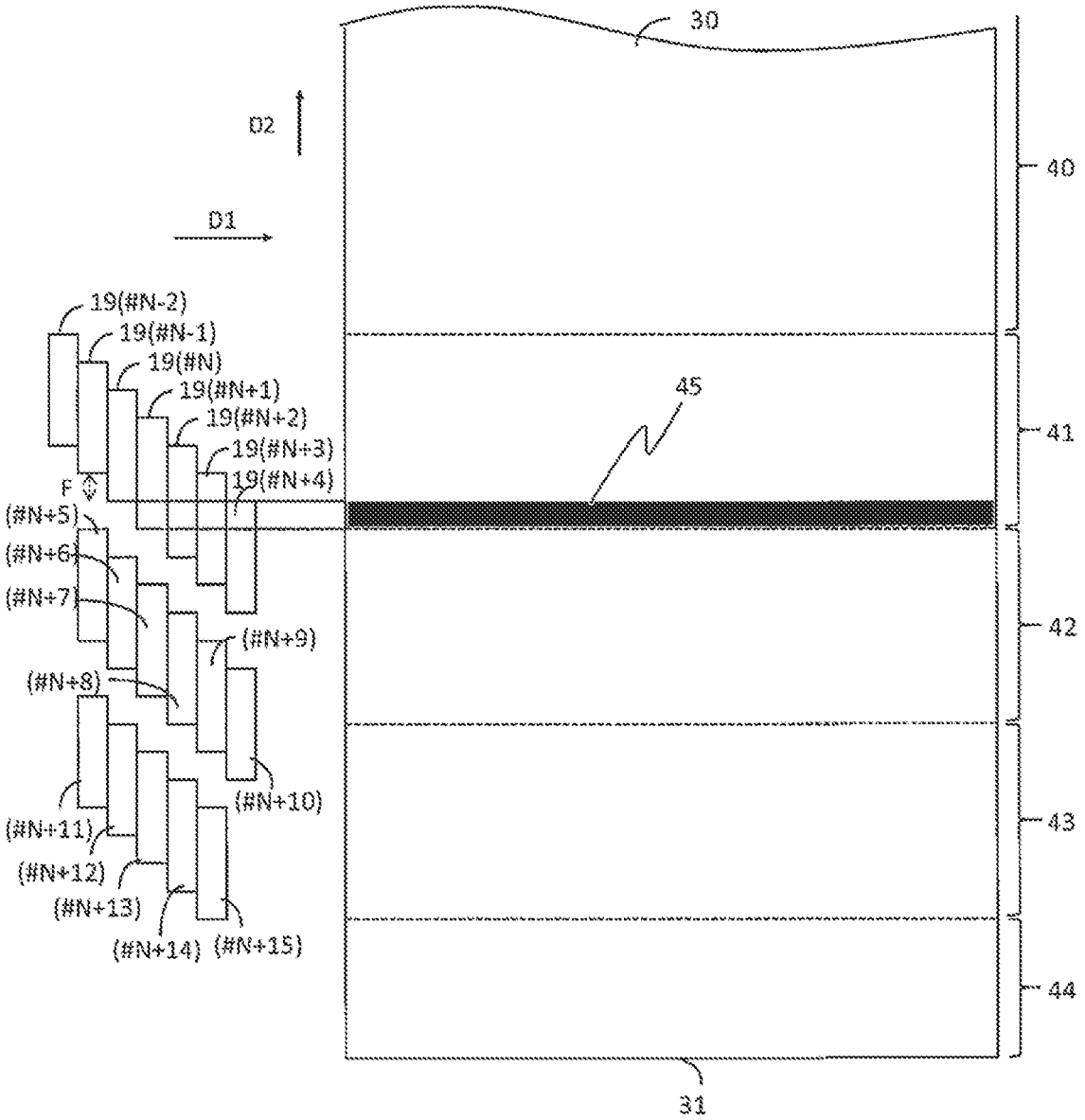
FIG. 5 is a view illustrating a printing medium and a printing head, of which the relative positions in a transport direction change.

Here, regions including the downstream adjustment region in the printing medium 30 will be described with reference to FIG. 5. FIG. 5 illustrates a portion of the printing medium 30 including the trailing end 31, and the printing head 19 of which the relative position with the printing medium 30 in the transport direction D2 changes. As illustrated in FIG. 2, the printing head 19 is mounted on the carriage 18 and has the nozzle rows 26. However. FIG. 5 illustrates the printing head 19 in a simplified manner as a simple rectangle.

The printing heads 19 illustrated in FIG. 5 all represent one and the same printing head 19. The position of the printing head 19 in the transport direction D2 is actually unchanged. In other words, FIG. 5 illustrates how the relative position between the printing medium 30 and the printing head 19 in the transport direction D2 changes each time a single paper feed of the printing medium 30 is carried out in the transport direction D2. According to FIG. 5, the transport amount by a single paper feed is "F". In FIG. 5, numbers such as #N enclosed in parentheses and accompanying the respective printing heads 19 stand for pass numbers. A pass number is a number indicating the ordinality of a pass in a single sheet of the printing medium 30. In other words, the printing head 19 with a pass number of #N represents the printing head 19 when the Nth pass is executed. In FIG. 5, due to space constraints, only the pass number is given for printing heads 19 having a pass number of #N+5 or greater, with reference sign 19 being omitted.

The transport amount F corresponds, for example, to ¼ of the length in the transport direction D2 of the nozzle rows 26. Furthermore, in FIG. 5, it is simply understood that the length in the transport direction D2 of the printing head 19 equals the length in the transport direction D2 of the nozzle rows 26. In such an example, the printing head 19 prints the same region of the printing medium 30 in four passes. For example, one region 45 in the printing medium 30 is printed in a total of four passes with a pass number from N+1 to N+4. Based on print data, an image in which a plurality of raster lines are aligned in the transport direction D2, that is, a bundle of raster lines are printed to the region 45. Each raster line is printed in a plurality of passes, and in four passes in the example of FIG. 5. Of course, in multi-pass printing, the number of passes required for print completion of a raster line is not limited to four.

FIG. 5 illustrates the printing medium 30 as being divided into regions 40, 41, 42, 43, and 44 in the transport direction D2. The region 42 is called a "low-velocity printing region 42". The low-velocity printing region 42 is a region that is printed by the printing head 19 in a period in which the trailing end 31 passes through the low-velocity range L. In other words, the low-velocity printing region 42 is a specific example of the "first region" of the printing medium 30 including a region that is a target of printing by the printing head 19 while the trailing end 31 passes through the first transport member and the printing medium 30 is transported by the second transport member. For the control unit 11, the low-velocity range L in the transport direction D2 and the position and size of the printing head 19 are known information. Furthermore, when printing to the printing medium 30 is started, the size of the printing medium 30 is also known information for the control unit 11. Accordingly, based on these pieces of information, the control unit 11 can calculate and identify the low-velocity printing region 42 of the printing medium 30. The control unit 11 sets, for example, a range from a position in the printing medium 30 corresponding to the leading end of the nozzle rows 26 when the trailing end 31 is positioned at the trailing end of the low-velocity range L to a position in the printing medium 30 corresponding to the trailing end of the nozzle rows 26 when the trailing end 31 is positioned at the leading end of the low-velocity range L as the low-velocity printing region 42.

Furthermore, as described above, in a situation where the transport amount F by a single paper feed by the transport unit 17 is known, the control unit 11 can calculate, for example, with the time when the top-of-form positioning is ended as a reference, what the ordinalities of passes that correspond to the period in which the low-velocity printing region 42 is to be printed by the printing head 19 (hereinafter, the first period) are. Here, with reference to FIG. 5, it is assumed that the control unit 11 judges, for example, that each pass with a pass number from #N+5 to #N+8 corresponds to the first period.

The control unit 11 sets an adjustment region 41 downstream of the low-velocity printing region 42 in the printing medium 30 and an adjustment region 43 upstream of the low-velocity printing region 42 in the printing medium 30. Here, it is assumed that one page's worth of print data used for printing to the printing medium 30 is data for printing some sort of image over the substantially entire surface from the leading end to the trailing end of the printing medium 30. The adjustment region 41 corresponds to the "second region," while the adjustment region 43 corresponds to the "fourth region". Hereinafter, the adjustment region 41 is called a downstream adjustment region 41, while the adjustment region 43 is called an upstream adjustment region 43. The control unit 11 makes the length in the transport direction D2 of each of the downstream adjustment region 41 and the upstream adjustment region 43 the same as the length in the transport direction D2 of the low-velocity printing region 42, for example.

Furthermore, the control unit 11 sets the region downstream of the downstream adjustment region 41 in the printing medium 30 as a normal region 40, and the region upstream of the upstream adjustment region 43 as a normal region 44. The normal regions 40 and 44 each correspond to the "third region". Hereinafter, the normal region 40 is called a downstream normal region 40, while the normal region 44 is called an upstream normal region 44.

The description now returns to FIG. 4. In step S110, the control unit 11 determines whether the paper feed to be executed after the pass executed in step S100 is a paper feed for the downstream adjustment region 41. With reference to FIG. 5, it is assumed that the control unit 11 judges, for example, that each pass with a pass number from #N−2 to #N+4 corresponds to the period in which the downstream adjustment region 41 is to be printed by the printing head 19 (hereinafter, the second period). In this case, if the paper feed to be executed after the pass executed in step S100 is a paper feed between a pass and another pass in the second period, a "Yes" determination may be made in step S110 to proceed to step S130. On the other hand, if the paper feed to be executed after the pass executed in step S100 is a paper feed for the downstream normal region 40, a "No" determination is made in step S110 to proceed to step S120. As in the example described above, assuming that each pass with a pass number from #N−2 to #N+4 is for the second period, the control unit 11 treats each pass with a pass number from #1 to #N−3 as a pass for the period in which the downstream normal region 40 is to be printed by the printing head 19 (hereinafter, the third period). Thus, if the paper feed to be executed after the pass executed in step S100 is a paper feed between a pass and another pass in the third period, a "No" determination may be made in step S110.

The control unit 11 similarly identifies each of the passes corresponding to the period in which the upstream adjustment region 43, which is the fourth region, is to be printed by the printing head 19 (hereinafter, the fourth period), and each of the passes corresponding to the period in which the upstream normal region 44, which is the upstream third region, is to be printed by the printing head 19. It can be said that the period in which the upstream normal region 44 is to be printed by the printing head 19 is also a type of the third period because it is a printing period for a normal region. However, in order to distinguish from the period in which the downstream normal region 40 is to be printed by the printing head 19 (third period), the period in which the upstream normal region 44 is to be printed by the printing head 19 is called a fifth period for convenience. In other words, in the time series, printing progresses in the order of the third period, the second period, the first period, the fourth period, and the fifth period. Note that just like the relationship between the last pass of the third period and the first pass of the second period, for example, the control unit 11 may treat, of two continuous periods (regions), the paper feed carried out between the last pass of one period (region) and the first pass of the other period (region) either as a paper feed for the one period (region) or as a paper feed for the other period (region).

In step S120, the control unit 11 controls the transport unit 17 so as to cause the same to execute a single paper feed at the velocity VU. Furthermore, in association with the paper feed, the control unit 11 causes the carriage 18 and the printing head 19 to stand by until the next pass execution. The standby time in step S120 is called the "normal standby time". The normal standby time corresponds to the standby time in the third period. No particular mention is made as to the details of the normal standby time. However, the time required for a single paper feed at the velocity VU may be simply grasped as the normal standby time. Following step S120, the control unit 11 performs step S100.

In step S130, a standby time for the downstream adjustment region is set. The standby time for the downstream adjustment region corresponds to the standby time in the second period. In the second period, the control unit 11 changes the standby time so that the standby time approaches the standby time in the first period (low-velocity standby time) from the standby time in the third period (normal standby time) as the first region (low-velocity printing region 42) approaches the printing head 19.

Figure 6A:
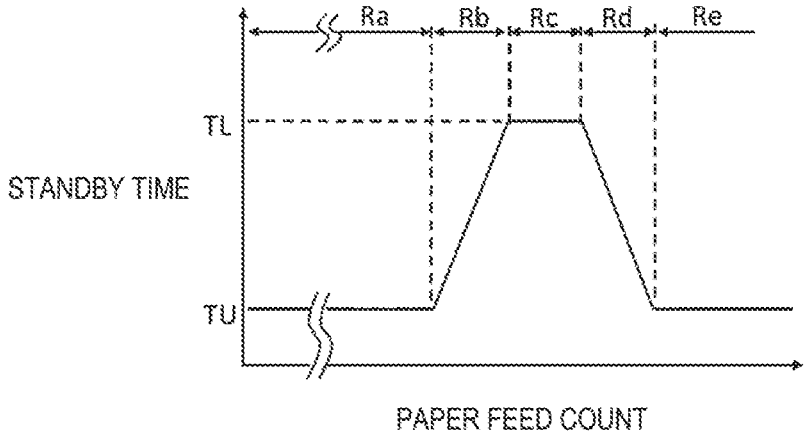
FIG. 6A is a view showing an example of a correspondence relationship between the paper feed count and the standby time in a graph.

FIG. 6A shows a correspondence relationship between the paper feed count and the standby time in a graph. A paper feed count is a number indicating the ordinality of a paper feed, with the paper feed immediately after the first pass on the printing medium 30 counted as the first. For example, the paper feed executed between a pass with a pass number of #N+1 and a pass with a pass number of #N+2 is a paper feed with a paper feed count of N+1. TU stands for normal standby time, while TL stands for low-velocity standby time. As is clear from FIG. 6A, TU<TL, wherein TU is the normal standby time, and TL is the low-velocity standby time.

A range Ra is a range of the paper feed count in the third period. The standby time associated with the paper feed executed between passes in the third period is each time the normal standby time TU. A range Rc is a range of the paper feed count in the first period. The standby time associated with the paper feed executed between passes in the first period is each time the low-velocity standby time TL. No particular mention is made as to the details of the low-velocity standby time. However, the time required for a single paper feed at the velocity VL may be simply set as the low-velocity standby time.

A range Rb is a range of the counts of paper feeds executed in the second period. As illustrated in FIG. 6A, the control unit 11 makes the standby time associated with the paper feed executed between passes in the second period longer so that the standby time approaches the low-velocity standby time TL from the normal standby time TU as the paper feed count increases.

Figure 6B:
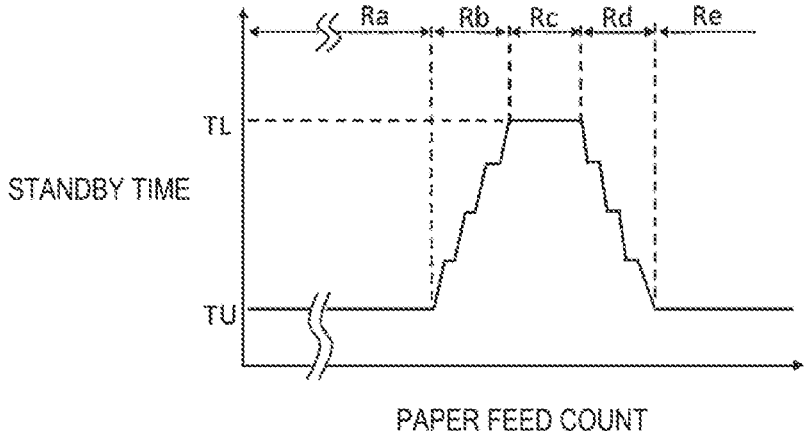
FIG. 6B is a view showing another example of a correspondence relationship between the paper feed count and the standby time in a graph.

FIG. 6B shows a correspondence relationship between the paper feed count and the standby time in a graph different from that of FIG. 6A. FIG. 6B differs from FIG. 6A only in terms of how the standby time changes in the range Rb and a range Rd. The standby time associated with the paper feed executed between passes in the second period need not necessarily be longer than the standby time associated with the preceding paper feed. As shown in the range Rb of FIG. 6B, the standby time may change stepwise. In other words, in the second period, the standby time associated with one paper feed may be the same as the standby time associated with the preceding paper feed. In either case, according to such FIG. 6A or 6B, in step S130, the control unit 11 sets a standby time equal to or greater than the standby time associated with the preceding paper feed as the standby time for the downstream adjustment region.

In step S140, the control unit 11 controls the transport unit 17 so as to cause the same to execute a single paper feed at the velocity VU. Furthermore, in association with the paper feed, the control unit 11 causes the carriage 18 and the printing head 19 to stand by until the next pass execution. The standby time in step S140 is the standby time set in step S130.

Note that the control unit 11 may execute the determination of step S110 and the setting of step S130 in parallel with the pass executed in step S100, and when the pass of step S100 is ended, immediately execute step S120 or step S140. Furthermore, such a configuration in which step S100 and steps S110 and S130 are performed in parallel can be similarly applied to the relationship between step S150 and steps S160 and S130, the relationship between step S180 and steps S190 and S200, and the relationship between step S220 and steps S230 and S200 to be described later.

Following step S140, in step S150, the control unit 11 controls the carriage 18 and the printing head 19 to execute a single pass on the printing medium 30. The pass executed in step S150 is a pass in the second period.

In step S160, the control unit 11 determines whether the paper feed to be executed after the pass executed in step S150 is a paper feed for the low-velocity printing region 42.

As described with reference to FIG. 5, it is assumed that the control unit 11 judges that each pass with a pass number from #N+5 to #N+8 corresponds to the first period. In this case, if the paper feed to be executed after the pass executed in step S150 is a paper feed between a pass and another pass in the first period, a "Yes" determination may be made in step S160 to proceed to step S170. On the other hand, if the paper feed to be executed after the pass executed in step S150 is a paper feed for the downstream adjustment region 41, that is, a paper feed between a pass and another pass in the second period, a "No" determination is made in step S160 and step S130 is executed again. Following a "No" determination in step S260, in step S130, as described above, the control unit 11 sets a standby time equal to or greater than the standby time set in step S130 in the preceding time with reference to the range Rb of the graph in FIG. 6A or FIG. 6B.

The velocity of paper feed of the printing medium 30 in step S140 is the same velocity VU as in step S120. On the other hand, the standby time in step S140 is longer than the normal standby time TU employed in step S120. Accordingly, in the relationship between step S120 and the subsequent step S100, for example, when a paper feed is ended, a pass is immediately started; in contrast, in the relationship between step S140 and the subsequent step S150, even after a paper feed is ended, the carriage 18 and the printing head 19 continue to stand by for a while, and then proceed to pass execution.

In step S170, the control unit 11 controls the transport unit 17 so as to cause the same to execute a single paper feed at the velocity VU. Furthermore, in association with the paper feed, the control unit 11 causes the carriage 18 and the printing head 19 to stand by until the next pass execution. The standby time in step S170 is the low-velocity standby time TL.

Following step S170, in step S180, the control unit 11 controls the carriage 18 and the printing head 19 to execute a single pass on the printing medium 30. The pass executed in step S180 is a pass in the first period.

In step S190, the control unit 11 determines whether the paper feed to be executed after the pass executed in step S180 is a paper feed for the upstream adjustment region 43. If the paper feed to be executed after the pass executed in step S180 is a paper feed between a pass and another pass in the fourth period, the control unit 11 may make a "Yes" determination in step S190 to proceed to step S200. On the other hand, if the paper feed to be executed after the pass executed in step S180 is a paper feed for the low-velocity printing region 42, that is, a paper feed between a pass and another pass in the first period, a "No" determination is made in step S190 and step S170 is executed again.

In step S200, a standby time for the upstream adjustment region is set. The standby time for the upstream adjustment region corresponds to the standby time in the fourth period. In the fourth period, the control unit 11 changes the standby time so that the standby time approaches the standby time in the third period (normal standby time TU) from the standby time in the first period (low-velocity standby time TL) as the third region (upstream normal region 44) upstream of the first region (low-velocity printing region 42) approaches the printing head 19.

Reference is again made to FIGS. 6A and 6B. The range Rd is a range of the counts of paper feeds executed in the fourth period, while a range Re is a range of the counts of paper feeds executed in the fifth period. The standby time associated with the paper feed executed between passes in the fifth period is each time the normal standby time TU. As illustrated in FIG. 6A, the control unit 11 makes the standby time associated with the paper feed executed between passes in the fourth period shorter so that the standby time approaches the normal standby time TU from the low-velocity standby time TL as the paper feed count increases. However, the standby time associated with the paper feed executed between passes in the fourth period need not necessarily be shorter than the standby time associated with the preceding paper feed. As shown in the range Rb of FIG. 6B, the standby time may change stepwise. In other words, in the fourth period, the standby time associated with one paper feed may be the same as the standby time associated with the preceding paper feed. In either case, according to FIG. 6A or 6B, in step S200, the control unit 11 sets a standby time equal to or less than the standby time associated with the preceding paper feed as the standby time for the upstream adjustment region.

In step S210, the control unit 11 controls the transport unit 17 so as to cause the same to execute a single paper feed at the velocity VU. Furthermore, in association with the paper feed, the control unit 11 causes the carriage 18 and the printing head 19 to stand by until the next pass execution. The standby time in step S210 is the standby time set in step S200.

Following step S210, in step S220, the control unit 11 controls the carriage 18 and the printing head 19 to execute a single pass on the printing medium 30. The pass executed in step S220 is a pass in the fourth period.

In step S230, the control unit 11 determines whether the paper feed to be executed after the pass executed in step S220 is a paper feed for the upstream normal region 44.

If the paper feed to be executed after the pass executed in step S220 is a paper feed between a pass and another pass in the fifth period, the control unit 11 may make a "Yes" determination in step S230 to proceed to step S240. On the other hand, if the paper feed to be executed after the pass executed in step S220 is a paper feed for the upstream adjustment region 43, that is, a paper feed between a pass and another pass in the fourth period, a "No" determination is made in step S220 and step S200 is executed again. Following a "No" determination in step S230, in step S200, as described above, the control unit 11 sets a standby time equal to or less than the standby time set in step S200 in the preceding time with reference to the range Rd of the graph in FIG. 6A or FIG. 6B.

The velocity of paper feed of the printing medium 30 in step S210 is the same velocity VU as in step S120. On the other hand, the standby time in step S210 is longer than the normal standby time TU. Accordingly, in the relationship between step S210 and the subsequent step S220, even after a paper feed is ended, the carriage 18 and the printing head 19 continue to stand by for a while, and then proceed to pass execution.

In step S240, the control unit 11 controls the transport unit 17 so as to cause the same to execute a single paper feed at the velocity VU. Furthermore, in association with the paper feed, the control unit 11 causes the carriage 18 and the printing head 19 to stand by until the next pass execution. The standby time in step S240 is the normal standby time TU. In other words, step S240 represents the same processing as that of step S120.

Following step S240, in step S250, the control unit 11 controls the carriage 18 and the printing head 19 to execute a single pass on the printing medium 30. The pass executed in step S250 is a pass in the fifth period. As simply illustrated by a dashed line with an arrow in FIG. 4, the control unit 11 repeats steps S240 and S250 until the last pass based on one page's worth of print data used for printing to the printing medium 30 is executed. In response to the pass corresponding to the last pass being executed in step S250, the control unit 11 ends the flowchart of FIG. 4. Of course, the control unit 11 can control the transport unit 17 to transport the printing medium 30 for which the last pass is ended downstream of the printing head 19 so as to discharge to a paper discharge tray (not illustrated) or the like.

3. Description of Advantageous Effects

As described above, according to the present embodiment, the printing apparatus 10 includes: the printing head 19 configured to execute a pass for ejecting liquid while moving forward along the main scanning direction D1 and a pass for ejecting liquid while moving backward along the main scanning direction D1; the transport unit 17 configured to transport the printing medium 30 in the transport direction D2 intersecting the main scanning direction D1 using the first transport member and the second transport member; and the control unit 11 configured to perform multi-pass printing in which a raster line along the main scanning direction D1 is printed in a plurality of passes on the printing medium 30 by controlling the printing head 19 and the transport unit 17. The first transport member is a roller pair disposed upstream of the printing head 19 in the transport direction D2. The second transfer member is disposed downstream of the printing head 19 in the transport direction D2. In addition, the control unit 11, with a region of the printing medium 30 including a region that is a target of printing by the printing head 19 while the trailing end 31, which is an upstream end portion of the printing medium 30 in the transport direction D2, passes through the first transport member and the printing medium 30 is transported by the second transport member set as a first region, a region downstream of the first region in the printing medium 30 set as a second region, and a region downstream of the second region in the printing medium 30 set as a third region, in a first period in which the first region is a target of printing by the printing head 19, makes a velocity of transport of the printing medium executed by the transport unit 17 between a pass and another pass slower than in a third period in which the third region is a target of printing by the printing head 19, in the first period, makes a standby time of the printing head 19 between a pass and another pass longer than in the third period, and in a second period in which the second region is a target of printing by the printing head 19, changes the standby time so that the standby time approaches the standby time in the first period (low-velocity standby time TL) from the standby time in the third period (normal standby time TU) as the first region approaches the printing head 19.

According to the above-described configuration, in order to suppress the kicking phenomenon from occurring when the trailing end 31 of the printing medium 30 passes through the first transport member, the velocity of paper feed is decreased in the first period, which makes the standby time in the first period longer than in other periods. In a configuration in which multi-pass printing is performed, the standby time serves as a drying time until a dot of liquid ejected to the printing medium 30 in a previous pass is overlapped with or brought into contact with a dot of liquid ejected in a later pass. Such difference in the drying time gives rise to difference in density in printing results. In such a situation, the control unit 11 sets a second region downstream of the first region between the third region and the first region. In the second period in which the second region is a target of printing, the control unit 11 makes the standby time longer as the paper feed count increases. This makes the drying time gradually longer in the second region connecting the third region and the first region, causing the density of printing results to change in gradation. Therefore, density unevenness due to difference in density between the third region having a short drying time and the first region having a long drying time is made inconspicuous thanks to the effect of such density change in gradation, which practically reduces density unevenness.

Furthermore, according to the present embodiment, the control unit 11, with a region upstream of the first region in the printing medium 30 set as a fourth region and a region upstream of the fourth region in the printing medium 30 set as a third region, in a fourth period in which the fourth region is a target of printing by the printing head 19, further changes the standby time so that the standby time approaches the standby time in the third period (normal standby time TU) from the standby time in the first period (low-velocity standby time TL) as the third region upstream of the first region approaches the printing head 19.

According to the above-described configuration, the control unit 11 sets a fourth region upstream of the first region between the third region and the first region. In the fourth period in which the fourth region is a target of printing, the control unit 11 makes the standby time shorter as the paper feed count increases. This makes the drying time gradually shorter in the fourth region connecting the first region and the upstream third region, causing the density of printing results to change in gradation. Therefore, density unevenness due to difference in density between the first region having a long drying time and the upstream third region having a short drying time is made inconspicuous thanks to the effect of such density change in gradation, which practically reduces density unevenness.

Note that at which position of the printing medium 30 printing to the printing medium 30 based on print data is ended, that is, on which region of the printing medium 30 the last pass proves to be depends on print data. Although not particularly illustrated in FIG. 4, depending on print data, any of the passes in steps S100, S150, S180, and S220 can prove to be the last pass. Therefore, for example, a pass directed to the first region can prove to be the last pass for the printing medium 30. When a pass directed to the first region proves to be the last pass for the printing medium 30, it is of course unnecessary to control passes, paper feeds, or standby time directed to the fourth region or the third region upstream of the fourth region.

The present embodiment discloses a printing apparatus and a printing system. Further, the present embodiment discloses a method executed by this apparatus or this system, and the program 12 that causes a processor to execute this method.

The printing method includes a printing control step for performing multi-pass printing in which a raster line along the main scanning direction D1 is printed in a plurality of passes on the printing medium 30 by controlling the printing head 19 configured to execute a pass for ejecting liquid while moving forward along the main scanning direction D1 and a pass for ejecting liquid while moving backward along the main scanning direction D1 and the transport unit 17 configured to transport, using a first transport member disposed upstream of the printing head 19 and a second transport member disposed downstream of the printing head 19 in the transport direction D2 intersecting the main scanning direction D1, the printing medium 30 in the transport direction D2. The first transport member is a roller pair. In the printing control step, with a region of the printing medium 30 including a region that is a target of printing by the printing head 19 while the trailing end 31, which is an upstream end portion of the printing medium 30 in the transport direction D2, passes through the first transport member and the printing medium 30 is transported by the second transport member set as a first region, a region downstream of the first region in the printing medium 30 set as a second region, and a region downstream of the second region in the printing medium 30 set as a third region, in a first period in which the first region is a target of printing by the printing head 19, a velocity of transport of the printing medium executed by the transport unit 17 between a pass and another pass is slower than in a third period in which the third region is a target of printing by the printing head 19, in the first period, a standby time of the printing head 19 between a pass and another pass is longer than in the third period, and in a second period in which the second region is a target of printing by the printing head 19, the standby time is changed so as to approach the standby time in the first period (low-velocity standby time TL) from the standby time in the third period (normal standby time TU) as the first region approaches the printing head 19.

4. Other Description

The length in the transport direction D2 of the second region is a length close to the shorter length of the length in the transport direction D2 of the first region and the length in the transport direction D2 of the third region.

The first region printed in a period in which the paper feed velocity is temporarily slowed in order to suppress the kicking phenomenon from occurring represents only a portion of the printing medium 30. Accordingly, in many cases, the first region is shorter in length in the transport direction D2 than the third region. In the example of FIG. 5 as well, the low-velocity printing region 42 is shorter in length in the transport direction D2 than the downstream normal region 40. In consideration of such a situation, in the example of FIG. 5, the control unit 11 makes each of the downstream adjustment region 41 and the upstream adjustment region 43 equivalent in length in the transport direction D2 to the low-velocity printing region 42. Note that each of the downstream adjustment region 41 and the upstream adjustment region 43 and the low-velocity printing region 42 need not have an identical length in the transport direction D2. By adopting such a configuration, in the printing result on the printing medium 30, the region in which density changes in gradation is prevented from spreading out as much as possible. If the low-velocity printing region 42 is longer in length in the transport direction D2 than the downstream normal region 40, the control unit 11 may make each of the downstream adjustment region 41 and the upstream adjustment region 43 equivalent in length in the transport direction D2 to the downstream normal region 40.

As will be understood from the description above, in the first period and the second period, the standby time is longer compared with that of the third period. During the standby time, maintenance of the printing head 19 can be performed. Therefore, the control unit 11 makes the number of times maintenance is performed by the printing head 19 per unit time in the first period and the second period greater than the number of times maintenance is performed by the printing head 19 per unit time in the third period. Maintenance herein means, for example, cleaning to remove dirt on the nozzle surface 21, flushing that forcibly causes liquid ejection from each nozzle 20 to improve ejection failure, and the like. The maintenance unit 27 constitutes at least part of a member necessary for such maintenance. The maintenance unit 27 is, for example, a wiper for cleaning the nozzle surface 21, an absorbent material or a receptacle for receiving dots ejected from each nozzle 20 by flushing, and the like. According to such a configuration, a relatively long standby time in the first period and the second period can be effectively utilized to perform maintenance of the printing head 19.

The control unit 11 need not necessarily cause the carriage 18 and the printing head 19 to execute forward passes and backward passes. For example, the control unit 11 may perform printing to the printing medium 30 only in forward passes. In this case, it is necessary to cause the carriage 18 to execute, between a forward pass and a next forward pass, backward movement as an empty pass in which no liquid ejection is performed. Alternatively, the control unit 11 may perform printing to the printing medium 30 only in backward passes. In this case, it is necessary to cause the carriage 18 to execute, between a backward pass and a next backward pass, forward movement as an empty pass in which no liquid ejection is performed. The control unit 11 causes backward movement or forward movement as an empty pass to be executed within a standby time associated with paper feed. In other words, standby time does not mean a period of time in which the carriage 18 and the printing head 19 are not moved at all. Standby time is also a period of time in which the carriage 18 or the printing head 19 is caused to execute maintenance-related operations described above other than printing, or operations that need to be done before the start of the next pass.

What is claimed is:

1. A printing apparatus comprising:

a printing head configured to execute a pass for ejecting liquid while moving forward along a main scanning direction and a pass for ejecting liquid while moving backward along the main scanning direction;

a transport unit configured to transport a printing medium in a transport direction intersecting the main scanning direction using a first transport member and a second transport member; and a control unit configured to perform multi-pass printing in which a raster line along the main scanning direction is printed in a plurality of passes on the printing medium by controlling the printing head and the transport unit; wherein the first transport member is a roller pair disposed upstream of the printing head in the transport direction, the second transport member is disposed downstream of the printing head in the transport direction, and provided that a region of the printing medium including a region that is a target of printing by the printing head while a trailing end, which is an upstream end portion of the printing medium in the transport direction, passes through the first transport member and the printing medium is transported by the second transport member is a first region, a region downstream of the first region in the printing medium is a second region, and a region downstream of the second region in the printing medium is a third region, the control unit, in a first period in which the first region is a target of printing by the printing head, causes a velocity of transport of the printing medium executed by the transport unit between the pass and a pass next to the pass to be slower than in a third period in which the third region is a target of printing by the printing head, in the first period, causes a standby time of the printing head between the pass and a pass next to the pass to be longer than in the third period, and in a second period in which the second region is a target of printing by the printing head, changes the standby time so that the standby time approaches the standby time in the first period from the standby time in the third period as the first region approaches the printing head.

2. The printing apparatus according to claim 1, wherein the control unit causes the number of times maintenance is performed by the printing head per unit time in the first period and the second period to be greater than the number of times maintenance is performed by the printing head per unit time in the third period.

3. The printing apparatus according to claim 1, wherein a length in the transport direction of the second region is a length close to a shorter length of a length in the transport direction of the first region and a length in the transport direction of the third region.

4. The printing apparatus according to claim 1, wherein provided that a region upstream of the first region in the printing medium is a fourth region and a region upstream of the fourth region in the printing medium is a third region, the control unit, in a fourth period in which the fourth region is a target of printing by the printing head, changes the standby time so that the standby time approaches the standby time in the third period from the standby time in the first period as the third region upstream of the first region approaches the printing head.

5. A printing method comprising:

a printing control step for performing multi-pass printing in which a raster line along a main scanning direction is printed in a plurality of passes on a printing medium by controlling a printing head configured to execute a pass for ejecting liquid while moving forward along the main scanning direction and a pass for ejecting liquid while moving backward along the main scanning direction and a transport unit configured to transport the printing medium in the transport direction using a first transport member disposed upstream of the printing head and a second transport member disposed downstream of the printing head in a transport direction intersecting the main scanning direction, wherein the first transport member is a roller pair and in the printing control step, provided that a region of the printing medium including a region that is a target of printing by the printing head while a trailing end, which is an upstream end portion of the printing medium in the transport direction, passes through the first transport member and the printing medium is transported by the second transport member is a first region, a region downstream of the first region in the printing medium is a second region, and a region downstream of the second region in the printing medium is a third region, in a first period in which the first region is a target of printing by the printing head, a velocity of transport of the printing medium executed by the transport unit between the pass and a pass next to the pass is slower than in a third period in which the third region is a target of printing by the printing head, in the first period, a standby time of the printing head between the pass and a pass next to the pass is longer than in the third period, and in a second period in which the second region is a target of printing by the printing head, the standby time is changed so as to approach the standby time in the first period from the standby time in the third period as the first region approaches the printing head.

* * * * *